United States Patent [19]

Yamada et al.

[11] Patent Number: 4,678,745

[45] Date of Patent: Jul. 7, 1987

[54] PROCESS FOR PRODUCING SILVER HALIDE EMULSION AND SILVER HALIDE PHOTOGRAPHIC LIGHT-SENSITIVE MATERIAL CONTAINING THE SAME

[75] Inventors: Sumito Yamada; Hiroyuki Mifune; Shigeharu Urabe, all of Kanagawa, Japan

[73] Assignee: Fuji Photo Film Co., Ltd., Kanagawa, Japan

[21] Appl. No.: 744,596

[22] Filed: Jun. 14, 1985

[30] Foreign Application Priority Data

Jun. 15, 1984 [JP] Japan ..... 59-122981

[51] Int. Cl.[4] ..... G03C 1/02

[52] U.S. Cl. ..... 430/569; 430/567; 430/599; 430/607; 430/608

[58] Field of Search ..... 430/567, 569, 603, 606, 430/608, 599, 607

[56] References Cited

U.S. PATENT DOCUMENTS

| | | | |
|---|---|---|---|
| 1,574,944 | 3/1926 | Sheppard | 430/603 |
| 3,021,215 | 2/1962 | Williams et al. | 430/603 |
| 3,057,724 | 10/1962 | Lovett et al. | 430/603 |
| 3,672,900 | 6/1972 | Kurz | 430/569 |
| 3,697,281 | 10/1972 | Milton | 430/603 |
| 4,063,951 | 12/1977 | Bogg | 430/567 |
| 4,399,215 | 8/1983 | Wey | 430/567 |
| 4,477,565 | 10/1984 | Himmelwright | 430/567 |

*Primary Examiner*—Won H. Louie

*Attorney, Agent, or Firm*—Sughrue, Mion, Zinn, Macpeak and Seas

[57] ABSTRACT

A process for producing a tabular silver halide emulsion by using a sulfur-containing silver halide solvent that promotes growth of silver halide grains, and a light-sensitive material containing the emulsion are disclosed. The grain growth effect of the silver halide solvent is reduced or eliminated by using an oxidizing agent thereby excluding the adverse effect of the silver halide solvent upon chemical ripening.

24 Claims, No Drawings

PROCESS FOR PRODUCING SILVER HALIDE EMULSION AND SILVER HALIDE PHOTOGRAPHIC LIGHT-SENSITIVE MATERIAL CONTAINING THE SAME

FIELD OF THE INVENTION

This invention relates to a silver halide photographic light-sensitive material. More particularly, it relates to a novel process for producing a silver halide emulsion containing tabular silver halide grains having a grain diameter at least three times a grain thickness and to a silver halide photographic light-sensitive material containing a tabular silver halide emulsion prepared by the novel process.

BACKGROUND OF THE INVENTION

It is well known that photographic sensitivity can be heightened by increasing the grain size of silver halide crystals. Increasing the silver halide grain size is often effected by using a so-called silver halide solvent which accelerates growth of silver halide crystal grains during precipitation of silver halides or the subsequent physical ripening. In cases where an emulsion of tabular silver halide grains is used as in the present invention, the silver halide solvent plays a very important role in not only controlling the mean grain size or grain size distribution but also changing the ratio of the grain diameter to the grain thickness.

The silver halide solvents which can be used include nitrogen-containing silver halide solvents the nitrogen atom of which coordinates with a silver ion to accelerate growth of grains as typically exemplified by ammonia, and sulfur-containing silver halide solvents the sulfur atom of which coordinates with a silver ion to accelerate growth of grains, such as thioether compounds, thione compounds and thiocyanates.

Among these silver halide solvents, the nitrogen-containing compounds, e.g., ammonia, can be deactivated by neutralization with acids to lose its coordination with silver ions. In other words, ammonia is characterized by serving as a silver halide solvent for accelerating grain growth only when needed and losing its effect on grain growth upon being neutralized with acids and, therefore, is easy to use. After silver halide crystals are formed in the presence of ammonia, if the ammonia is neutralized with acids, it neither induces unnecessary physical ripening to cause changes of crystals during the subsequent chemical ripening with a chemical sensitizer nor influences the chemical ripening itself. Further, it does not hinder various compounds added until coating, e.g., sensitizing dyes, antifoggants, stabilizers, etc., from adsorption onto silver halide crystals.

However, use of ammonia involves problems such that application is seriously restricted to a high pH condition and also fog is apt to increase. In addition, application of ammonia as a silver halide solvent to tabular grains having a diameter at least 3 times, particularly at least 5 times, the thickness fails to produce grains that can fully manifest their inherent characteristics, such as a high covering power and excellent color sensitizing property. For example, Japanese Patent Application (OPI) No. 108526/83 (corresponding to U.S. Pat. No. 4,435,501 and British Pat. No. 2,111,231) (the term "OPI" as used herein refers to a "published unexamined Japanese patent application") and Japanese Patent Application (OPI) No. 113928/83 (corresponding to U.S. Pat. No. 4,434,226 and British Pat. No. 2,109,576) describe ammonia as being an unfavorable physical ripening agent in a silver iodobromide emulsion containing tabular grains having a large diameter/thickness ratio (these patents refer to this ratio as the "aspect ratio"). Accordingly, ammonia in the state of the art is undesirable as a silver halide solvent in the preparation of tabular silver halide emulsions.

On the other hand, the sulfur-containing silver halide solvents, such as thioether compounds, thione compounds, thiocyanates, etc., are preferred for the preparation of tabular silver halide grains. However, it has hitherto been impossible to deactivate these sulfur-containing solvents to cause them to lose their effect except for removal by washing with water. Washing for ceasing the grain growth effect entails a great increase in both cost and time for the production of silver halide emulsions and is, thereofre, unsuitable for practical operation. Moreover, these sulfur-containing silver halide solvents cannot be completely removed even by washing with water and some portion remains in the emulsion because of the strong affinity of the sulfur-containing solvents for silver halide grains compared with ammonia. The silver halide solvents remaining in the emulsion produce various adverse effects during chemical ripening. For example: fog is increased; physical ripening proceeds simultaneously with chemical ripening to cause the disappearance of sensitivity specks on the surface of the grains; chemical ripening is hard to stop by cooling or with adsorbing additives; and the like. The residual silver halide solvents also promote deterioration of photographic performance properties during preservation or hinder various additives, such as sensitizing dyes, from adsorption.

Nevertheless, sulfur-containing silver halide solvents facilitate mono-dispersion or tabular silver halide grains having a large diameter/thickness ratio as compared with ammonia as mentioned above and, above all, realize preparation of tabular silver halide emulsions having high photographic sensitivity. In addition, the sulfur-containing silver halide solvents have various advantages in that uniform distribution of iodine in a silver iodobromide emulsion is easily accomplished; growth of grains is accelerated even at a low pH level; silver halide grains relatively insensitive to pressure applied on films can be produced; and so on.

For all these reasons, it has been desired to develop a method capable of reducing or eliminating the grain growth effect of the sulfur-containing silver halide solvents whenever required as is achieved by using acids against ammonia.

SUMMARY OF THE INVENTION

Accordingly, an object of this invention is to provide a process for producing a tabular silver halide emulsion by using a sulfur-containing silver halide solvent, which process is free from the above described disadvantages associated with the use of said sulfur-containing silver halide solvent.

Another object of this invention is to provide a process for producing a tabular silver halide emulsion, in which chemical ripening can adequately be carried out by suppressing influences of a sulfur-containing silver halide solvent used during formation of silver halide grains or during growth of said grains, and a tabular silver halide photographic light-sensitive material containing the emulsion produced by the above process.

A further object of this invention is to provide a process for producing a tabular silver halide emulsion, in which a grain growth effect of a sulfur-containing silver halide solvent is controlled, said silver halide solvent being used during formation of silver halide grains or during growth of said grains, and to provide a photographic light-sensitive material containing the tabular silver halide emulsion prepared by the above process.

As a result of extensive investigations, it has now been found that the grain growth effect of sulfur-containing silver halide solvents can be reduced or eliminated at any desired stage without accompanying noticeable deterioration of photographic properties by adding oxidizing agents hereinafter described.

More specifically, the above described objects can be accomplished by a process for producing a tabular silver halide emulsion using a sulfur-containing silver halide solvent that promotes growth of silver halide grains, in which an oxidizing agent capable of reducing or eliminating the grain growth effect of the sulfur-containing silver halide solvent is used, and by a silver halide photographic light-sensitive material comprising a support having provided thereon at least one layer containing the tabular silver halide emulsion prepared by the above described process.

DETAILED DESCRIPTION OF THE INVENTION

The sulfur-containing silver halide solvents that can be used in the present invention are silver halide solvents capable of coordinating with silver ions via sulfur atoms thereof.

More specifically, the term "silver halide solvent" as used herein means that water or a mixed solvent of water-organic solvent (e.g., water/methanol=1/1 by weight) containing 0.02M silver halide solvent at 60° can dissolve silver halide in an amount twice or more the weight of silver halide which can be dissolved in water or the mixed solvent thereof at 60° C. in the absence of the silver halide solvent.

Examples of such sulfur-containing silver halide solvents include thiocyanates (e.g., potassium thiocyanate, ammonium thiocyanate, etc.), organic thioether compounds (e.g., the compounds described in U.S. Pat. Nos. 3,574,628, 3,021,215, 3,057,724, 3,038,805, 4,276,374, 4,297,439 and 3,704,130, Japanese Patent Application (OPI) No. 104926/82, etc.), thione compounds (e.g., tetra-substituted thiourea derivatives as described in Japanese Patent Applications (OPI) Nos. 82408/78 and No. 77737/80, U.S. Pat. No. 4,221,863, etc., and compounds as described in Japanese Patent Application (OPI) No. 144319/78), mercapto compounds capable of promoting growth of silver halide grains as described in Japanese Patent Application (OPI) No. 202531/82, and the like.

More specifically, the organic thioether compounds preferably include compounds represented by the formula (I):

$$R^1(S-R^3)_m-S-R^2 \quad (I)$$

wherein $R^1$ and $R^2$, which may be the same or different, each represents a lower alkyl group having from 1 to 5 carbon atoms or a substituted alkyl group having from 1 to 30 carbon atoms in total; or $R^1$ and $R^2$ may be taken together to form a cyclic thioether; $R^3$ represents a substituted or unsubstituted alkylene group preferably having from 1 to 12 carbon atoms; and m represents 0 or an integer of from 1 to 4; when m is 2 or more, a plurality of $R^3$ may be the same or different.

In the above described formula (I), the substituent for the lower alkyl group as represented by $R^1$ or $R^2$ includes, for example, —OH, —COOM, —$SO_3M$, —$NHR^4$, —$NR^4R^4$ (two $R^4$ groups may be the same or different), —$OR^4$, —$CONHR^4$, —$COOR^4$, a heterocyclic group, etc., wherein M represents a hydrogen atom or an alkali metal; and $R^4$ represents a hydrogen atom, a lower alkyl group or an alkyl group substituted with the above enumerated substituents. The substituted alkyl group for $R^1$ or $R^2$ may have one or more of these substituents which may be the same or different.

The alkylene group as represented by $R^3$ may contain one or more of —O—, —CONH—, —$SO_2NH$—, etc., in its alkylene chain. The substituents for the substituted alkylene group for $R^3$ are the same as described for $R^1$ and $R^2$.

The thione compounds preferably include compounds represented by the formula (II):

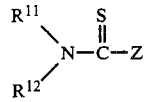

(II)

wherein Z represents

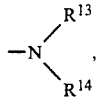

—$OR^{15}$ or —$SR^{16}$; $R^{11}$, $R^{12}$ $R^{13}$, $R^{14}$, $R^{15}$ and $R^{16}$, which may be the same or different, each represents a substituted or unsubstituted alkyl group, a substituted or unsubstituted alkenyl group, a substituted or unsubstituted aralkyl group, a substituted or unsubstituted aryl group, or a substituted or unsubstituted heterocyclic group, each preferably having a total carbon atom number of not more than 30; or a pair of $R^{11}$ and $R^{12}$, $R^{13}$ and $R^{14}$, $R^{11}$ and $R^{13}$, $R^{11}$ and $R^{15}$, or $R^{11}$ and $R^{16}$ may be taken together to form a substituted or unsubstituted 5- or 6-membered heterocyclic ring.

The mercapto compounds preferably include compounds represented by the formula (III):

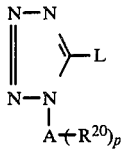

(III)

wherein A represents an alkylene group; $R^{20}$ represents —$NH_2$, —$NHR^{21}$,

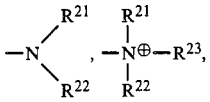

—$CONHR^{24}$, —$OR^{24}$, —COOM, —$COOR^{21}$, —$SO_2NHR^{24}$, —$NHCOR^{21}$ or —$SO_3M$, each preferably having a total carbon atom number of not more than 30; p represents 1 or 2; and L represents —S⊖ when $R^{20}$ is

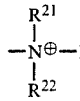

or L represents —SM when $R^{20}$ is a group other than

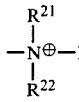

wherein $R^{21}$, $R^{22}$ and $R^{23}$ each represents an alkyl group; $R^{24}$ represents a hydrogen atom or an alkyl group; and M represents a hydrogen atom or a cation (e.g., an alkali metal ion, an ammonium ion, etc).

These compounds can be synthesized by the processes described in the above recited patents or patent applications. Some of them are commercially available.

Specific examples of the sulfur-containing silver halide solvents which can be used in the present invention are shown below:

KSCN (1)

$NH_4SCN$ (2)

$HO(CH_2)_2S(CH_2)_2OH$ (3)

$HO—(CH_2)_6S(CH_2)_5S(CH_2)_6OH$ (4)

$HO—(CH_2)_2—S—(CH_2)_2—S—(CH_2)_2—OH$ (5)

$HO—(CH_2)_3—S—(CH_2)_2—S—(CH_2)_3—OH$ (6)

$HO—(CH_2)_6—S—(CH_2)_2—S—(CH_2)_6—OH$ (7)

$HO(CH_2)_2S(CH_2)_2S(CH_2)_2S(CH_2)_2OH$ (8)

$HO(CH_2)_2S(CH_2)_2O(CH_2)_2O(CH_2)_2S(CH_2)_2OH$ (9)

$HOOCCH_2S(CH_2)_2SCH_2COOH$ (10)

$H_2NCO(CH_2)_2S(CH_2)_2S(CH_2)_2CONH_2$ (11)

$NaO_3S(CH_2)_3S(CH_2)_2S(CH_2)_3SO_3Na$ (12)

$HO(CH_2)_2S(CH_2)_2CONHCH_2NHCO(CH_2)_2S(CH_2)_2OH$ (13)

(14)

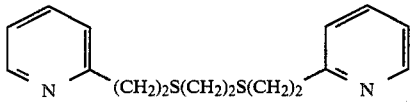

$HOCH_2\underset{\underset{OH}{|}}{C}HCH_2S(CH_2)_2SCH_2\underset{\underset{OH}{|}}{C}HCH_2OH$ (15)

$HOCH_2\underset{\underset{OH}{|}}{C}HCH_2S(CH_2)_2S(CH_2)_2SCH_2\underset{\underset{OH}{|}}{C}HCH_2OH$ (16)

$HOOC\underset{\underset{NH_2}{|}}{C}HCH_2S(CH_2)_2SCH_2\underset{\underset{NH_2}{|}}{C}HCOOH$ (17)

(18)

$HOCH_2\underset{\underset{OH}{|}}{C}HCH_2S(CH_2)_2CONHCH_2NHCO(CH_2)_2SCH_2\underset{\underset{OH}{|}}{C}HCH_2OH$ (19)

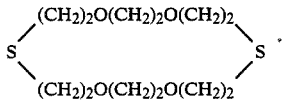

(20)

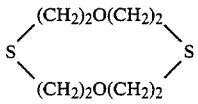

$CH_3SCH_2\underset{\underset{NH_2}{|}}{C}HCOOH$ (21)

-continued $C_2H_5S(CH_2)_2S(CH_2)_2NHCO(CH_2)_2COOH$ (22)

(23)

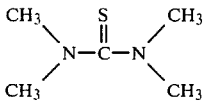

(24)

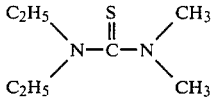

(25)

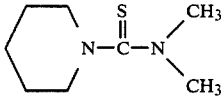

(26)

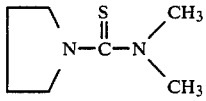

(27)

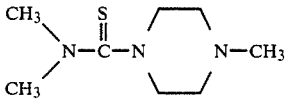

(28)

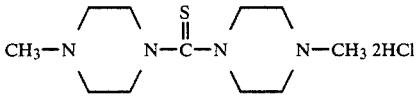

(29)

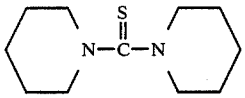

(30)

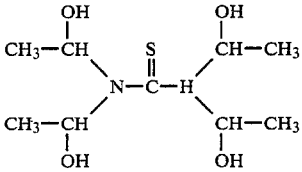

(31)

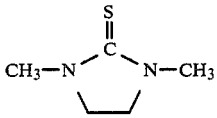

(32)

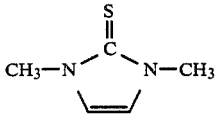

(33)

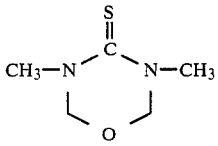

-continued (34)

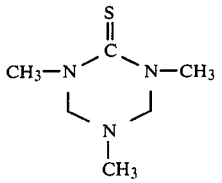

(35)

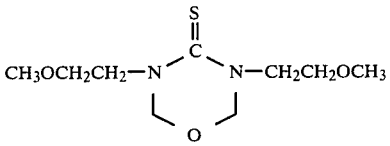

(36)

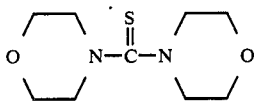

(37)

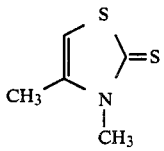

(38)

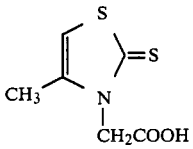

(39)

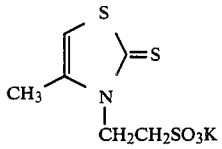

(40)

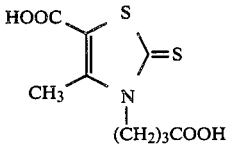

(41)

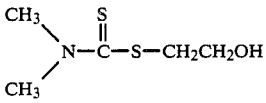

(42)

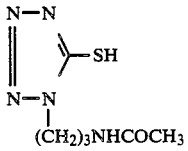

(43)

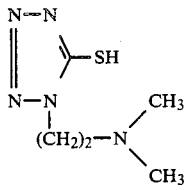

-continued (44)

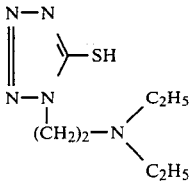

(45)

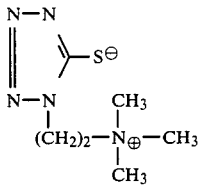

(46)

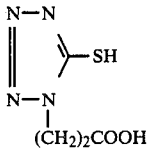

(47)

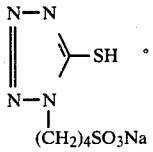

Reduction or elimination of the grain growth activity of the sulfur-containing silver halide solvents can be achieved by using so-called oxidizing agents. Oxidizing agents where the oxidation reduction potential of the sulfur-containing silver halide solvent is negative can be advantageously used.

The oxidizing agents which can be used in the present invention include organic or inorganic oxidizing agents.

Examples of the organic oxidizing agents are organic peroxides, e.g., peracetic acid, perbenzoic acid, and the like. Examples of the inorganic oxidizing agents include hydrogen peroxide (aqueous solution), adducts of hydrogen peroxide (e.g., $NaBO_2.H_2O_2.3H_2O$, $2NaCO_3.3H_2O_2$, $Na_4P_2O_7.2H_2O_2$, $2Na_2SO_4.H_2O_2.2H_2O$, etc.), peroxy acid salts (e.g., $K_2S_2O_8$, $K_2C_2O_6$, $K_4P_2O_8$, etc.), peroxy complex compounds (e.g., $K_2[Ti(O_2)C_2O_4].3H_2O$, $4K_2SO_4.Ti(O_2)OH.SO_4.2H_2O$, $Na_3[VO(O_2)(C_2O_4)_2].6H_2O$, etc.), oxyacid salts such as permanganates (e.g., $KMnO_4$, etc.) and chromates (e.g., $K_2Cr_2O_7$, etc.) and the like.

In addition, other oxidizing compounds, such as oxidizing gases (e.g., ozone, oxygen gas, etc.) and halogen-releasing oxidizing compounds (e.g., sodium hypochlorite, N-bromosuccinamide, etc.) can also be used.

Oxidizing agents suited for the objects of the present invention can be selected out of these oxidizing agents according to the methods shown in the following Test Examples 1 and 2. The preferred in the present invention are those compounds that can deactivate the sulfur-containing silver halide solvents without accompanying decomposition of gelatin or intense desensitization. Such a characteristic of the oxidizing agent can also be evaluated by examining photographic properties in accordance with the methods of the Test Examples or in a usual manner.

TEST EXAMPLE 1

To Solution I maintained at 50° C. under vigorous stirring were added simultaneously 20 ml of a 1N aqueous solution of silver nitrate and 20 ml of a 1M aqueous solution of potassium bromide over 30 minutes.

| Solution I: | |
|---|---|
| Inactive Gelatin | 3 g |
| Potassium Bromide | 180 mg |
| Water | 100 ml |

A silver halide solvent had been added to Solution I in advance, and an oxidizing agent had been added to Solution I 5 minutes before the addition of the silver nitrate and potassium bromide solutions, with its type and amount being shown in Table 1.

The resulting mixture was sampled immediately after the addition of silver nitrate and potassium bromide, and the sample was microscopically observed to determine the size of silver halide crystals. The results obtained are shown in Table 1.

As is apparent from Table 1, presence of a silver halide solvent makes silver halide crystals larger, but such a grain growth effect is weakened or excluded by the addition of an oxidizing agent. This is a surprising finding which has heretofore been unknown.

On the other hand, ammonia used as a silver halide solvent has its grain growth effect counteracted by neutralization with acids but does not lose its effect in the presence of an oxidizing agents.

Moreover, addition of an oxidizing agent alone did not make any difference in mean grain size from Emulsion No. 1 being 0.18 μm.

For comparison, the same procedure as described above was repeated except for using Comparative Compound (a) or (b) which was an oxidizing product of Compound (5) used as a sulfur-containing silver halide solvent. As predicted, these comparative compounds failed to show any grain growth effect to increase a silver halide crystal size.

TABLE 1

| Emulsion No. | Silver Halide Solvent Kind | Silver Halide Solvent Amount (mmol) | Oxidizing Agent Kind | Oxidizing Agent Amount | Mean Grain Size (μm) |
|---|---|---|---|---|---|
| 1 | — | — | — | — | 0.18 |
| 2 | (5) | 0.3 | — | — | 0.52 |
| 3 | " | " | $H_2O_3$ (35%) | 0.5 ml | 0.26 |
| 4 | " | " | " | 2.5 ml | 0.18 |
| 5 | " | " | $NaBO_2.H_2O_2.3H_2O$ * | 50 mg | 0.38 |
| 6 | " | " | $NaBO_2.H_2O_2.3H_2O$ * | 210 mg | 0.18 |
| 7 | " | " | $K_2S_2O_8$ | 210 mg | 0.18 |
| 18 | " | 0.6 | — | — | 0.75 |
| 9 | " | " | $H_2O_2$ (35%) | 2.5 ml | 0.18 |
| 10 | (6) | 0.2 | — | — | 0.55 |
| 11 | " | " | $H_2O_2$ (35%) | 2.8 ml | 0.18 |
| 12 | " | " | $NaBO_2.H_2O_2.3H_2O$ | 200 mg | 0.18 |
| 13 | (9) | 0.1 | — | — | 0.35 |
| 14 | " | " | $H_2O_2$ (35%) | 2.0 ml | 0.18 |
| 15 | (14) | 0.1 | — | — | 0.32 |
| 16 | " | " | $H_2O_2$ (35%) | 2.0 ml | 0.18 |
| 17 | (15) | 0.6 | — | — | 0.58 |
| 18 | " | " | $NaBO_2.H_2O_2.3H_2O$ | 350 mg | 0.21 |
| 19 | (19) | 0.5 | — | — | 0.60 |
| 20 | " | " | $NaBO_2.H_2O_2.3H_2O$ | 350 mg | 0.18 |
| 21 | " | " | $KMnO_4$ | 250 mg | 0.18 |
| 22 | (23) | 0.5 | — | — | 0.45 |
| 23 | " | " | $H_2O_2$ (35%) | 2.8 ml | 0.18 |

TABLE 1-continued

| Emulsion No. | Silver Halide Solvent Kind | Silver Halide Solvent Amount (mmol) | Oxidizing Agent Kind | Oxidizing Agent Amount | Mean Grain Size (μm) |
|---|---|---|---|---|---|
| 24 | (25) | 0.5 | — | — | 0.57 |
| 25 | " | " | $H_2O_2$ (35%) | 2.8 ml | 0.18 |
| 26 | (31) | 1 | — | — | 0.48 |
| 27 | " | " | $K_2S_2O_8$ | 540 mg | 0.20 |
| 28 | (33) | 0.5 | — | — | 0.51 |
| 29 | " | " | $NaBO_2.H_2O_2.3H_2O$ | 350 mg | 0.18 |
| 30 | (37) | 0.6 | — | — | 0.39 |
| 31 | " | " | $NaBO_2.H_2O_2.3H_2O$ | 350 mg | 0.18 |
| 32 | (44) | 0.4 | — | — | 0.41 |
| 33 | " | " | $NaBO_2.H_2O_2.3H_2O$ | 350 mg | 0.20 |
| 34 | (45) | 0.4 | — | — | 0.77 |
| 35 | " | " | $NaBO_2.H_2O_2.3H_2O$ | 350 mg | 0.28 |
| 36 | (1) | 3 | — | — | 0.45 |
| 37 | " | " | $H_2O_2$ (35%) | 1 ml | 0.22 |
| 38 | " | " | " | 3 ml | 0.18 |
| 39 | " | " | $O_3$ gas blown for 10 mins. | | 0.25 |
| 40 | $NH_3$ | 12 | — | — | 0.65 |
| 41 | " | " | $H_2O_2$ (35%) | 1 ml | 0.65 ** |
| 42 | " | " | " | 5 ml | 0.64 ** |
| 43 | " | " | neutralization with glacial acetic acid | | 0.18 |
| 44 | (a) *** | 0.6 | — | — | 0.18 |
| 45 | (b) *** | 0.6 | — | — | 0.18 |

Note:
* Since addition of $NaBO_2.H_2O_2.3H_2O$ increased the pH level, the pH was adjusted with an acid (hereinafter the same).
** Since addition of $H_2O_2$ slightly decreased the pH level, the pH was adjusted with sodium hydroxide.
*** Comparative Compound (a): $HO—(CH_2)_2SO(CH_2)_2SO(CH_2)_2OH$
Comparative Compound (b): $HO—(CH_2)_2SO_2(CH_2)_2SO_2(CH_2)_2OH$

TEST EXAMPLE 2

Each of Emulsion Nos. 1, 2, 8, 22 and 36 as prepared in Test Example 1 was devided in two. One of which was heated to 70° C. and stirred at that temperature for 20 minutes. To another portion was added an oxidizing agent, and the mixture was stirred at 70° C. for 20 minutes. The sizes of silver halide grains before and after the heating were determined in each portion. The results obtained are shown in Table 2.

It can be seen from Table 2 that the presence of a sulfur-containing silver halide solvent promites physical ripening making the crystal grain size larger, but such a grain growth effect is arrested by addition of an oxidizing agent.

TABLE 2

| Emulsion No. | Oxidizing Agent Kind | Oxidizing Agent Amount | Mean Grain Size Before Heating* (μm) | Mean Grain Size After Heating (μm) |
|---|---|---|---|---|
| 1 | — | — | 0.18 | 0.21 |
| " | $NaBO_2.H_2O_2.3H_2O$ | 105 mg | " | " |
| 2 | — | — | 0.52 | 0.78 |
| " | $K_2S_2O_8$ | 105 mg | " | 0.55 |
| 8 | — | — | 0.75 | 1.1 |
| " | $H_2O_2$ (35%) | 1.3 ml | " | 0.80 |
| 22 | — | — | 0.45 | 0.62 |
| " | $H_2O_2$ (35%) | 1.4 ml | " | 0.48 |
| 36 | — | — | 0.45 | 0.58 |
| " | $H_2O_2$ (35%) | 2 ml | " | 0.47 |

Note: The same as the mean grain size in Table 1.

Some of the oxidizing agents which are employable in the present invention decompose gelatin or exhibit striking desensitizing activity. The halogen-releasing oxidizing compounds particularly produce such adverse effects. Thus, in using such an oxidizing agent, it might be necessary to reduce its amount to be added.

The preferred among the above stated oxidizing agents are inorganic oxidizing agents and oxidizing gases, particularly the inorganic oxidizing agents. Among the inorganic oxidizing agents, the more preferred are hydrogen peroxide and adducts or precursors thereof.

In carrying out the present invention, the oxidizing agent can be used in the presence of a catalyst including sodium tungstate and a metal salt, e.g., iron salts, copper salts, etc.

These oxidizing agents can easily be synthesized and most of them are commercially available.

The amount of the sulfur-containing silver halide solvent to be used in the present invention can arbitrarily be selected depending on the type to be used and time of addition. Usually, it ranges from $10^{-6}$ to 20 mols, and preferably from $10^{-5}$ to 10 mols, per mol of silver halide.

The oxidizing agent is added in an amount determined in accordance with the amount of the sulfur-containinfg silver halide solvent used and the desired degree of deactivation. When it is required to completely deactivate the sulfur-containing silver halide solvent, at least stoichiometrically equilvalent amount of an oxidizing agent should be added. When deactivation is demanded to a certain degree, the amount of the oxidizing agent should be so adjusted. For example, the oxidizing agent is usually added in an amount of from 1/100 to 100 molar times based on the silver halide solvent.

The silver halide solvent and oxidizing agent is usually added as a solution in water or a water-soluble organic solvent, such as alcohols, ethers, glycols, ketones, esters, amides, etc.

Since the reaction between the sulfur-containing silver halide solvent and the oxidizing agent can be controlled by temperature and/or addition of catalyst, etc., incorporation of the oxidizing agent may be conducted before and/or after the addition of the sulfur-containing silver halide solvent, but is preferably conducted after the addition of the silver halide solvent.

Addition of the oxidizing agent may be conducted at any stage from the formation of tabular silver halide grains through the time immediately before coating. In the cases when the silver halide emulsion is subjected to chemical ripening with chemical sensitizers, the oxidizing agent is preferably added by the time before commencement of the chemical ripening. More preferably, the oxidizing agent is added to the system after the start of grain growth of tabular silver halide grains and before commencement of the chemical ripening.

In a preferred embodiment according to the present invention, silver nitrate and/or a halide are(is) added to a system previously containing a silver halide solvent to thereby accelerate growth of tabular silver halide grains, and an oxidizing agent is added thereto either during or after the growth of the tabular silver halide grains. In the latter case, the addition may be effected at any stage before coating, for example, before or after physical ripening, at the time of washing, at the time of chemical ripening, and the like, and preferably before commencement of the chemical ripening.

In another preferred embodiment according to the present invention, a sulfur-containing silver halide solvent is added to a system containing silver nitrate and/or a halide during or after formation of tabular silver halide grains or during or after growth of grains, and then an oxidizing agent is added thereto at any stage before coating, such as after physical ripening, at the time of washing, at the time of chemical ripening, etc., and preferably before commencement of the chemical ripening.

In a further preferred embodiment of the present invention, silver nitrate and/or a halide are(is) added to a system previously containing a sulfur-containing silver halide solvent to thereby form and/or grow tabular silver halide grains, or a sulfur-containing silver halide solvent is added to a system in the course of formation or growth of tabular silver halide grains to thereby promote the formation or growth of grains; and then an oxidizing agent is added thereto simultaneously with or followed by addition of silver nitrate and/or a halide with care not to cause renucleation to thereby form double layered grains. If the above procedure is repeated, multilayered grains can easily be produced.

The mechanism accounting for deactivation of sulfur-containing silver halide solvents with the oxidizing agents according to the present invention is safely assumed to be as follows but this explanation is not intended to be binding:

In the case where the silver halide solvent is a thioether compound, —S— is oxidized into —SO— or —$SO_2$— incapable of coordinating with a silver ion. In fact, the aforesaid Test Example 1 demonstrates that the comparative compounds, i.e., oxidized products of a thioether compound, had no effect any longer to promote growth of silver halide grains. The same mechanism can be applied to the thiocyanates or thione compounds; that is, oxidation incapacitates these compounds from coordinating with silver ions and results in loss of their grain growth effect.

Thus, the deactivation method according to the present invention is applicable to any sulfur-containing silver halide solvent which exhibits a grain growth effect through coordination of its sulfur atom with a silver ion.

Use of the above described oxidizing agent in accordance with the present invention makes it possible to prevent the sulfur-containing silver halide solvent from being carried into the step of chemical ripening thereby weakening or excluding the adverse influences of the solvent upon the chemical ripening.

In some cases, use of the oxidizing agent in accordance with the present invention brings about an increase in contrast, or prevents the sulfur-containing silver halide from hindering adsorption of various additives, such as sensitizing dyes.

Further, the activity of the sulfur-containing silver halide solvent can be controlled by using the above described oxidizing agent during or after the formation or growth of tabular silver halide grains, thus making it possible to easily produce multilayered grains as well as to easily produce mono-dispersed grains.

When the oxidizing agent of the present invention is used in a large quantity, the excess can be deactivated by adding a reducing material which serves to reduce the oxidizing agent used, such as sulfites, sulfinic acids, reducing sugars, etc., so as to exclude the adverse effects of the oxidizing agent upon the subsequent chemical ripening and the like.

The reducing material is preferably added before the commencement of chemical ripening, and more preferably before the commencement of chemical ripening and after the addition of the oxidizing agent.

The amount of the reducing material is appropriately selected according to the type of the oxidizing agent used or the desired degree of deactivation, and is usually an equimole or more, and preferably from an equimole to 5 molar times, based on the oxidizing agent.

It has conventionally been known to use an oxidizing agent in the preparation of silver halide emulsions. For example, it is known to use a halogen-releasing oxidizing agent in the halogenation step for preparing silver halides from silver carbonates in the production of heat developable light-sensitive materials. It is also known to add an oxidizing agent for prevention of fog in the production of general silver halide emulsions or the aforesaid heat-developable light-sensitive materials. These conventional usages of oxidizing agents are described, e.g., in British Pat. Nos. 1,498,956 and 1,389,501 and U.S. Pat. Nos. 4,028,129, 4,213,784 and 3,957,491. However, the purpose and effect of the oxidizing agents in these patents or patent applications are entirely different from those contemplated in the present invention.

The tabular silver halide grains that can be used in this invention will hereinafter be described.

The tabular silver halide grains used in the present invention have a diameter to thickness ratio of at least 3, preferably from 5 to 50, and more preferably from 5 to 20.

The term "diameter" as herein used means a diameter of a circle having the same surface area as that of the projected surface area of a grain at issue. The tabular silver halide grains according to the present invention is from 0.3 to 5.0 μm, and preferably from 0.5 to 3.0 μm.

The thickness of the tabular silver halide grains of the present invention is not more than 0.4 μm, preferably not more than 0.3 μm, and most preferably not more than 0.2 μm.

In general, tabular silver halide grains have a plate form having two parallel planes. Therefore, the term "thickness" as herein used denotes a distance between the two parallel planes constituting the tabular silver halide grain.

A preferred halogen composition of the tabular silver halide grains includes silver bromide and silver iodobromide, with silver iodobromide containing up to 30 mol% of silver iodide being particularly preferred.

These tabular silver halide grains can be prepared by an appropriate combination of processes known in the art, for example, by a process comprising forming seed crystals comprising 40% by weight or more of tabular grains in an atmosphere having a relatively low pBr value of 1.3 or smaller and allowing the formed seed crystals to grow while adding a silver salt solution and a halide solution simultaneously, with the pBr value being maintained constant at that level. It is desirable to add the silver salt and halide solutions while taking care not to generate new crystal nuclei.

The desired size of the tabular silver halide grains can be attained by controlling the temperature, type and amount of the solvent, rates of adding the silver salt and halide during the growth of grains, and the like.

The grain size, shape of grains including a diameter/thickness ratio, grain size distribution, and rate of growth of grains can be controlled by using the silver halide solvent in the preparation of the tabular silver halide grains.

For example, an increase in an amount of the silver halide solvent makes grain size distribution narrow and increases the rate of growth of grains. To the contrary, there is a tendency for the grain thickness to increase as the amount of the solvent increases.

In the preparation of the tabular silver halide grains according to the present invention, methods of increasing the rates of addition, amounts and concentrations of a silver salt solution (e.g., an $AgNO_3$ aqueous solution) and a halide solution to be added are employed in order to accelerate growth of grains.

For the details of these methods, reference can be made to, e.g., British Pat. No. 1,335,925, U.S. Pat. Nos. 3,672,900, 3,650,757 and 4,242,445 and Japanese Patent Applications (OPI) Nos. 142329/80, 158124/80, 113927/83, 113928/83, 111934/83 and 111936/83, etc.

The tabular silver halide grains of the present invention can be subjected to chemical sensitization, if desired.

Chemical sensitization can be carried out by gold sensitization using a gold compound, as described in, e.g., U.S. Pat. Nos. 2,448,060 and 3,320,069; noble metal sensitization using a noble metal, e.g., iridium, platinum, rhodium, palladium, etc., as described, e.g., in U.S. Pat. Nos. 2,448,060, 2,566,245 and 2,566,263; sulfur sensitization using a sulfur-containing compound, as described, e.g., in U.S. Pat. No. 2,222,264; reduction sensitization using a tin salt, a polyamine, etc., as described, e.g., in U.S. Pat. Nos. 2,487,850, 2,518,698 and 2,521,925; or a combination of two or more thereof.

From the standpoint of saving silver, it is preferred to employ gold sensitization or sulfur sensitization or a combination thereof for chemical sensitization of the tabular silver halide grains according to the present invention.

A layer in which the tabular silver halide grains according to the present invention are incorporated preferably contains at least 40% by weight, and more preferably at least 60% by weight, of the tabular silver halide grains based on the total silver halide grains present in the layer.

There is no particular limitation on various additives which constitute the tabular silver halide grain-containing layer according to the present invention, such as a binder, a hardener, an antifoggant, a stabilizer for silver halides, a surface active agent, a spectral sensitizing dye, a dye, an ultraviolet ray absorbent, a chemical sensitizer, and the like. Reference can be made to it, e.g., in *Research Disclosure,* Vol. 176, pages 22–28 (December, 1978).

The emulsion layer of the silver halide photographic light-sensitive material according to the present invention can contain ordinary silver halide grains in addition to the tabular silver halide grains. The ordinary silver halide grains can be prepared by the processes described in P. Glafkides, *Chimie et Physique Photographique,* Paul Montel (1967), G. F. Duffin, *Photographic Emulsion Chemistry,* The Focal Press (1966), V. L. Zelikman et al., *Making and Coating Photographic Emulsion,* The Focal Press (1964), etc. In more detail, the silver halide grains can be prepared by any of the acid process, the neutral process, the ammonia process, etc. The reaction between the soluble silver salt and soluble halogen salt can be effected by a single jet method, a double jet method or a combination thereof.

In addition, a method in which silver halide grains are produced in the presence of excess silver ions (the so-called reverse mixing method) can also be employed. Further, the so-called controlled double jet method, in which the pAg of the liquid phase wherein silver halide grains are to be precipitated is maintained constant, may be employed.

The silver halide may be any of silver bromide, silver iodobromide, silver iodochlorobromide, silver chlorobromide, silver chloride and the like.

In a process of producing silver halide grains or allowing the produced silver halide grains to physically ripen, cadmium salts, zinc salts, lead salts, thallium salts, iridium salts or complexes thereof, rhodium salts or complexes thereof, iron salts or complexes thereof, etc., may be present. The silver halide grains may be chemically sensitized, if desired, as in the case of the tabular silver halide grains.

For the purpose of preventing fog during preparation, preservation or photographic processing, or for stabilizing photographic properties, the photographic emulsion which can be used in the present invention can contain various conventional compounds. Examples of such compounds include azoles, such as benzothiazolium salts, nitroindazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (particularly 1-phenyl-5-mercaptotetrazole), etc.; mercaptopyrimidines; mercaptotriazines; thioketo compounds, such as oxazolinethione; azaindenes, such as triazaindenes, tetraazaindenes (particularly 4-hydroxy-substituted (1,3,3a,7)tetraazaindenes), pentaazaindenes, etc.; benzenethiosulfonic acid; benzenesulfinic acid; benzenesulfonic acid amide; meso-ionic compounds, such as nitroso compounds; and many other compounds known as antifoggants or stabilizers. For details of specific examples and usages of these compounds, disclosures given in U.S. Pat. Nos. 3,954,474 and 3,982,947 and Japanese Patent Publication No. 28660/77 can be referred to.

The photographic emulsion used in the present invention is preferably spectrally sensitized with methine dyes or others.

The dyes which can be used for spectral sensitization include cyanine dyes, merocyanine dyes, complex cyanine dyes, complex merocyanine dyes, holopolar cyanine dyes, hemicyanine dyes, styryl dyes and hemioxonol dyes, with cyanine dyes, merocyanine dyes and complex merocyanine dyes being particularly useful. Any of the basic heterocyclic nuclei commonly used in cyanine dyes can be applied to these dyes. Examples of such nuclei include a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc.; the above describe nuclei to which an alicyclic hydrocarbon ring has been fused; and the above described nuclei to which an aromatic hydrocarbon ring has been fused, such as an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc. These nuclei may have substituents on their carbon atoms.

The merocyanine dyes or complex merocyanine dyes can have attached thereto 5- or 6-membered heterocyclic nuclei having a ketomethylene structure, such as a pyrazolin-5-one nucleus, a thiohydantoin nucleus, a 2-thiooxazolidine-2,4-dione nucleus, a thiazolidine-2,4-dione nucleus, a rhodanine nucleus, a thiobarbituric acid nucleus, etc.

The above described sensitizing dyes can be used either alone or in combinations thereof. A combination of sensitizing dyes is frequently employed for the purpose of supersensitization.

The emulsion may contain, in addition to the sensitizing dye, a dye which does not exhibit per se any spectrally sensitizing activity or a substance which does not substantially absorb visible light, both of which show supersensitizing effects when used in combination with the sensitizing dye. Such a dye or substance can include, for example, aminostilbene compounds substituted with a nitrogen-containing heterocyclic group, such as those disclosed in U.S. Pat. Nos. 2,933,390 and 3,635,721; condensates between an aromatic organic acid and formaldehyde, such as those disclosed in U.S. Pat. No. 3,743,510; cadmium salts, azaindene compounds; and the like. The preferred are the combinations disclosed in U.S. Pat. Nos. 3,615,613, 3,615,641, 3,617,295 and 3,635,721.

The photographic emulsion layer of the photographic light-sensitive material according to the present invention may contain color forming couplers, i.e., compounds capable of forming colors by oxidative coupling with aromatic primary amine developers (e.g., phenylenediamine derivatives, aminophenol derivatives, etc.). Examples of magenta couplers include 5-pyrazolone couplers, pyrazolobenzimidazole couplers, cyanoacetylcumarone couplers, open chain acylacetonitrile couplers and the like. Examples of yellow couplers include acylacetamide couplers (e.g., benzoyl acetanilides, pivaloyl acetanilides, etc.), and the like. Examples of cyan couplers include naphthol couplers, phenol couplers and the like. These couplers are desirably nondiffusible, having a hydrophobic group called a ballast group in the molecule. The couplers may be either 4-equivalent or 2-equivalent with respect to silver ions. Moreover, they may be colored couplers having a color correcting effect, or couplers capable of releasing development inhibitors with the progress of development (the so-called DIR couplers).

In addition to the DIR couplers, non-color-forming DIR coupling compounds which yield colorless products upon coupling and release development inhibitors may be used.

Other additives constituting the photographic emulsion layer of the silver halide photographic light-sensitive material of the present invention are not particularly restricted. For example, a binder, a surface active agent, a dye, an ultraviolet ray absorbent, a hardener, a coating aid, a thickener, a plasticizer, etc., as described in *Research Disclosure,* Vol. 176, page 22–28 (December, 1978) can be used, if desired.

The photographic material of the present invention preferably has, on its surface, a surface protective layer mainly comprising gelatin or a synthetic or natural high polymeric substance, e.g., water-soluble polyvinyl compounds and acrylamide polymers, as described in U.S. Pat. Nos. 3,142,568, 3,193,386 and 3,062,674.

The surface protective layer can contain, in addition to gelatin or other high polymeric substances, a surface active agent, an antistatic agent, a matting agent, a slipping agent, a hardener, a thickener, and the like.

The photographic material according to the present invention may further have an intermediate layer, a filter layer, an antihalation layer, and the like, if desired.

The photographic emulsion layers or other layers are coated on a conventional flexible support, such as a plastic film, paper, cloth or the like, or a rigid support, such as glass, ceramic, metal or the like. Examples of flexible supports which can be used to advantage include films made from semi-synthetic or synthetic high molecular weight polymers, such as cellulose nitrate, cellulose acetate, cellulose acetate butyrate, polystyrene, polyvinyl chloride, polyethylene terephthalate, polycarbonate, etc.; and paper coated or laminated with a baryta layer or an α-olefin polymer (e.g., polyethylene, polypropylene, an ethylene-butene copolymer, etc.).

Supports may be colored with dyes or pigments. Further, they may be rendered black for the purpose of shielding light. The surfaces of these supports are, in general, subjected to a subbing treatment to increase adhesiveness to photographic emulsion layers. Before or after receiving the subbing treatment, the surfaces of the support may be subjected to a corona discharge treatment, an ultraviolet irradiation treatment, a flame treatment, or the like.

Coating of the layer containing the tabular silver halide grains, the emulsion layer or the surface protective layer on a support can advantageously be carried out in accordance with the multilayer simultaneous coating method as described, e.g., in U.S. Pat. Nos. 2,761,418, 3,508,947 and 2,761,791, etc.

Layer structures of the photographic materials in accordance with the present invention can include various embodiments, for example, (1) a structure comprising a support having coated thereon a layer containing the tabular silver halide grains of the present invention and further coated thereon a surface protective layer composed of gelatin; (2) a structure comprising a support having coated thereon a layer containing the tabular silver halide grains of the present invention, further coated thereon a silver halide emulsion layer containing highly sensitive spherical silver halide grains having a relatively large size, e.g., 0.5 to 3.0 μm in diameter, or polyhedral silver halide grains having a diameter/thickness ratio of 3 or less, and furthermore provided thereon a surface protective layer composed of gelatin or the like; (3) a structure comprising a support having provided thereon a layer containing the tabular silver halide grains, further provided thereon a plurality of silver halide emulsion layers, and furthermore provided thereon a gelatin surface protective layer; (4) a structure comprising a support having coated thereon one silver halide emulsion layer, further coated thereon a layer containing th tabular silver halide grains, furthermore coated thereon a highly sensitive silver halide emulsion layer, and moreover provided thereon a gelatin surface protective layer; (5) a structure comprising a support having provided thereon a layer containing an ultraviolet absorbent or dye, a layer containing the tabular silver halide grains, a silver halide emulsion layer, and a gelatin surface protective layer in this order; and (6) a structure comprising a support having provided thereon a layer containing the tabular silver halide grains and an ultraviolet absorbent or dye, a silver halide emulsion layer, and a gelatin surface protective layer in this order. In any of these layer structures, the silver halide emulsion layer may be formed on both sides of the support. The silver halide emulsion layer may be not only a single layer but also a multilayer composed of a plurality of silver halide emulsion layers spectrally sensitized to different wavelengths.

The silver halide photographic light-sensitive materials according to the present invention specifically include black-and-white photosensitive materials, such as X-ray film (indirect films and direct films inclusive), lith films, black-and-white photographic papers, black-and-white negative films, silver salt diffusion photosensitive materials, etc.; and color photosensitive materials, such as color negative films, color reversal films, color papers, color diffusion transfer photosensitive materials, etc.

Known methods and processing solutions, as described, e.g., in *Research Disclosure,* No. 176, pages 28–30 (RD-17643), can be applied to photographic processing of the light-sensitive materials according to the present invention. Any photographic processing, whether for the formation of silver images (monochromatic photographic processing) or for the formation of dye images (color photographic processing), can be used depending on the end use of the light-sensitive material. Processing temperatures are usually selected from 18° C. to 50° C., but temperatures out of this range may also be used.

Developing solutions used for black-and-white photographic processing can contain known developing agents, including dihydroxybenzenes (e.g., hydroquinone), 3-pyrazolidones (e.g., 1-phenyl-3-pyrazolidone), aminophenols (e.g., N-methyl-p-aminophenol), etc. These developing agents can be used alone or in combination thereof. The developing solutions may generally contain conventional preservatives, alkali agents, pH buffers, antifoggants, etc., and may further contain, if desired, dissolution aids, toning agents, development accelerators (e.g., quaternary salts, hydrazine, benzyl alcohol, etc.), surface active agents, defoaming agents, water softeners, hardeners (e.g., glutaraldehyde), viscosity imparting agents and the like.

The photographic emulsions according to the present invention can be processed by the so-called lith development. The term "lith development" means a development processing for photographic reproduction of a line image or a halftone dot image, in which development is conducted infectiously at a low sulfite ion concentration generally using a dihydroxybenzene as a developing agent. The details for the lith development are described in Mason, *Photographic Processing Chemistry,* pages 163–165 (1966).

Development process may be carried out by a method in which a developing agent is contained in the light-sensitive material, e.g., in an emulsion layer, and the material is development processed in an aqueous alkaline solution. Developing agents which are hydrophobic can be incorporated in emulsion layers by various methods, such as those described in *Research Disclosure,* No. 169 (RD-16928), U.S. Pat. No. 2,739,890, British Pat. No. 813,253 and West German Pat. No. 1,547,763. Such development processing may be carried out in combination with silver salt stabilization processing using a thiocyanate.

Fixing solutions which can be used in the present invention may have any compositions commonly employed in the art. Fixing agents to be used include thiosulfates, thiocyanates as well as organic sulfur compounds known to have a fixing effect. The fixing solution may contain a water-soluble aluminum salt as a hardener.

Formation of dye images can be effected by known methods including, for example, the negative-positive method, as described in *Journal of the Society of Motion*

*Picture and Television Engineers,* Vol. 61, pages 667–701 (1953); a color reversal process comprising developing a light-sensitive material with a developing solution containing a black-and-white developing agent to obtain a negative silver image, and subjecting the silver image to at least one uniform exposure to light or any other appropriate fogging treatment, followed by color developing to obtain a color positive image; a silver dye bleach process, in which photographic emulsion layers containing dyes are exposed and developed to form a silver image and the dyes are bleached by catalytic action of the resulting silver; and the like.

Color developing solutions generally comprise an alkaline aqueous solution containing a color developing agent. The color developing agents which can be used include known primary aromatic amine developers, such as phenylenediamines, e.g., 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline, 4-amino-3-methyl-N-ethyl-N-β-methoxyethylaniline, etc.

In addition to the above described color developing agents, those described in L. F. A. Mason, *Photographic Processing Chemistry,* pages 226–229, Focal Press (1966), U.S. Pat. Nos. 2,193,015 and 2,592,364, Japanese Patent Application (OPI) No. 64933/73, and so on may also be employed.

The color developing solution can additionally contain a pH buffer, a development inhibitor, an anti-foggant, a water softener, a preservative, an organic solvent, a development accelerator, a polycarboxylic acid series chelating agent, and the like.

Specific examples of these additives are disclosed, e.g., in *Research Disclosures* (RD-17643), U.S. Pat. No. 4,083,723, West German Patent Application (OLS) No. 2,622,950, etc.

The present invention will now be illustrated in greater detail with reference to the following examples, but it should be understood that these examples are not meant to limit the present invention.

EXAMPLE 1

(1) Preparation of Comparative Tabular Grains

A solution containing potassium bromide, a thioether of the formula: $HO(CH_2)_2S(CH_2)_2S(CH_2)_2OH$ (Compound 5) and gelatin was heated to 70° C., and a silver nitrate solution and a mixture solution of potassium iodide and potassium bromide were added to the solution maintained at 70° C. under stirring according to a double jet method.

The resulting mixture was cooled to 35° C., and soluble salts were removed by a sedimentation process. Thereafter, the mixture was again heated to 40° C., and 60 g of gelatin was added thereto, followed by pH adjustment to 6.8.

The resulting tabular silver halide grains were found to have an average diameter of 1.25 μm, a thickness of 0.15 μm, an average diameter/thickness ratio of 8.33, and a silver iodide content of 3 mol%. It had a pAg value of 8.95 at 40° C.

The emulsion was chemically sensitized by a combination of gold sensitization and sulfur sensitization. Amounts and ratio of gold and sulfur, temperature and time employed in the chemical sensitization were determined so as to be the optimum conditions when fog was 0.01.

To the chemically sensitized solution were added 500 mg of anhydro-5,5'-dichloro-9-ethyl-3,3'-di(3-sulfopropyl)oxacarbocyanine hydroxide sodium salt as a sensitizing dye and 200 mg of potassium iodide each per mol of silver to effect green-sensitization. 4-Hydroxy-6-methyl-1,3,3a,7-tetraazaindene and 2,6-bis(hydroxyamino)-4-diethylamino-1,3,5-triazine as stabilizers, a coating aid and a hardener were also added thereto. The resulting emulsion was coated on a polyethylene terephthalate support together with a surface protective layer by coextrusion. The thickness of the surface protective layer was 1.2 μm, and the silver coverage was 2.5 g/m$^2$.

The thus prepared sample was designated as Sample A.

(2) Preparation of Comparative Tabular Grains

The same procedure aas described in (1) above was repeated except that the time of the chemical ripening was extended so as to attain the possible highest sensitivity. The resulting tabular silver halide grains had an average diameter of 1.25 μm, a thickness of 0.15 μm, an average diameter/thickness ratio of 8.33, and a silver iodide content of 3 mol%. It had a pAg value of 8.95 at 40° C. The resulting sample was designated as Sample B.

(3) Preparation of Tabular Grains According to Invention

The same procedure as described in (1) above up to the removal of soluble salts by a sedimentation process was repeated. The resulting tabular silver halide grains had an average diameter of 1.25 μm, a thickness of 0.15 μm, and an average diameter/thickness ratio of 8.33. To the resulting mixture was added 3 ml of 3.5 wt% aqueous hydrogen peroxide, and the mixture was subjected to a combination of gold sensitization and sulfur sensitization. Since the hydrogen peroxide deactivated the thioether remaining in the emulsion even after washing with water by a sedimentation process, the adverse influences of the thioester were excluded and, therefore, the optimum conditions for chemical sensitization changed. After the conditions for chemical sensitization were closely examined in the same manner as for Sample A, the same kinds and amounts of sensitizing dye, potassium iodide, stabilizers, coating aid and hardener were added to the emulsion. The resulting emulsion was coated on a polyethylene terephthalate support together with a surface protective layer by coextrusion to a silver coverage of 2.5 g/m$^2$. The sample thus prepared was designated as Sample C.

(4) Preparation of Tabular Grains According to Invention

Tabular silver halide grains were prepared in the same manner as described in (3) above except that the temperature for the formation of tabular grains was lowered to 60° C. The resulting tabular grains had an average diameter of 0.78 μm, a thickness of 0.145 μm and an average diameter/thickness ratio of 5.38. The emulsion was subjected to chemical sensitization in the same manner as for Sample C. Additives were then added thereto and the resulting emulsion was coated on a support in the same manner as for Sample A. The sample thus prepared was designated as Sample D.

(5) Evaluation of Photographic Properties and Graininess

Each of Samples A, B, C and D was uniformly exposed to green light using a color filter which blocked light of wavelengths of shorter than 480 nm. The exposed sample was developed with Developing Solution A having the following composition at 20° C. for 4 minutes, fixed with Fixing Solution B having the following composition and washed with water. The results obtained are shown in Table 3. In Table 3, "relative sensitivity" was calculated from an exposure required to obtain a blackening density of fog+1.0. "RMS" which represents graininess was measured at an average density of 1.0 using an aperture of 48×48 μm.

| Composition of Developing Solution A: | |
|---|---|
| 1-Phenyl-3-pyrazolidone | 0.5 g |
| Hydroquinone | 20.0 g |
| Disodium Ethylenediaminetetraacetate | 2.0 g |
| Potassium Sulfite | 60.0 g |
| Boric Acid | 4.0 g |
| Potassium Carbonate | 20.0 g |
| Sodium Bromide | 5.0 g |
| Diethylene Glycol | 30.0 g |
| Water to make | 1 liter (adjusted to pH 10.0 with NaOH) |
| **Composition of Fixing Solution B:** | |
| Ammonium Thiosulfate | 200.0 g |
| Anhydrous Sodium Sulfite | 20.0 g |
| Boric Acid | 8.0 g |
| Disodium Ethylenediaminetetraacetate | 0.1 g |
| Ammonium Sulfate | 15.0 g |
| Sulfuric Acid | 2.0 g |
| Glacial Acetic Acid | 22.0 g |
| Water to make | 1 liter (adjusted to pH 4.2) |

TABLE 3

| Sample No. | Fog | Relative Sensitivity | RMS |
|---|---|---|---|
| A (Comparison) | 0.01 | 100 (standard) | 0.038 |
| B (Comparison) | 0.13 | 120 | 0.040 |
| C (Invention) | 0.01 | 170 | 0.037 |
| D (Invention) | 0.01 | 105 | 0.029 |

It can be seen from Table 3 that Sample A prepared without using aqueous hydrogen peroxide showed low sensitivity, and variation of the degree of chemical sensitization failed to improve sensitivity, only resulting in remarkable increase of fog (Sample B).

In marked contrast to Samples A and B, Sample C wherein the silver halide solvent had been deactivated by using aqueous hydrogen peroxide prior to chemical sensitization showed a significantly improved sensitivity, with its graininess being substantially equal to that of Sample A or B.

Further, Sample D using tabular grains having a small grain size exhibited conspicuously improved graininess while showing the equal sensitivity to Sample A.

In addition, Sample C according to the present invention or Sample A (comparative sample) was subjected to development processing involving surface development and internal development as described in Japanese Patent Application (OPI) No. 86039/84 (corresponding to West German Patent Application (OLS) No. 3,340,363). The results obtained revealed that Sample C has higher surface sensitivity and a markedly reduced internal sensitivity as compared with Sample A.

It can be inferred from these results that use of the oxidizing agent according to the present invention prevents formation of internal latent image specks which is caused by undesirable physical ripening having occurred during chemical ripening due to the remaining silver halide solvent and, as a result, brings about such a conspicuous improvement in sensitivity as is noted in Sample C.

EXAMPLE 2

(1) Preparation of Comparative Tabular Grains

The same procedure as described in Example 1-(1) except for using an increased amount of the thioether compound was repeated to prepare Sample E.

(2) Preparation of Comparative Tabular Grains

The same procedure as described in Example 1-(1) except for using a decreased amount of the thioether compound was repeated to prepare Sample F.

(3) Preparation of Tabular Grains According to Invention

Sample G was prepared in the same manner as described in (1) above except that 30 ml of 3.5 wt% aqueous hydrogen peroxide was added to the solution for formation of tabular grains when half of the total amount of the silver nitrate solution had been added to the solution.

(4) Evaluation of Photographic Properties

Each of Samples E, F and G was exposed and developed in the same manner as in Example 1. Results obtained are shown in Table 4.

TABLE 4

| Sample No. | Average Diameter of Projected Area (μm) | Average Thickness (μm) | Fog | Relative Sensitivity |
|---|---|---|---|---|
| E (Comparison) | 1.05 | 0.155 | 0.22 | 100 (standard) |
| F (Comparison) | 1.53 | 0.137 | 0.02 | 130 |
| G (Invention) | 1.50 | 0.138 | 0.02 | 182 |

It can be seen from Table 4 that relative sensitivity is increased (Sample F) by using silver halide grains having an average diameter/thickness ratio increased over that of Sample E by reducing the amount of the thioether compound as a silver halide solvent, while relative sensitivity can be remarkably improved by using hydrogen peroxide without increasing fog (Sample G).

EXAMPLE 3

(1) Preparation of Samples

Emulsions were prepared in the same manner as in Example 1-(1), (3) and (4) up to chemical sensitization, and the additives shown in Table 5 were added to each of the chemically sensitized emulsions. The resulting emulsion was coated on a triacetyl cellulose film support having provided thereon a subbing layer together with a protective layer to the silver coverage shown in Table 5. The resulting coated samples were designated as Samples H, I and J, respectively.

TABLE 5

| Layer | Component | Coverage |
|---|---|---|
| Emulsion Layer | Emulsion | $2.1 \times 10^{-2}$ mol/m$^2$ (as Ag) |
| | Coupler* | $1.5 \times 10^{-3}$ mol/m$^2$ |
| | Tricresyl phosphate | 1.10 g/m$^2$ |
| | Gelatin | 2.30 g/m$^2$ |
| Protective Layer | Sodium 2,4-dichloro-triazine-6-hydroxy-s-triazine | 0.08 g/m$^2$ |

TABLE 5-continued

| Layer | Component | Coverage |
|---|---|---|
| | Gelatin | 1.80 g/m$^2$ |

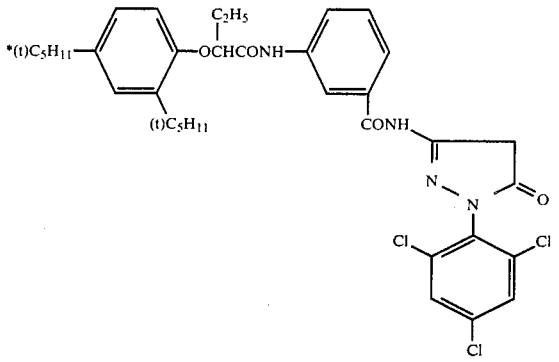

Each of the samples was allowed to stand at 40° C. and 70% RH for 14 hours, sensitometrically exposed, and subjected to color devleopment processing as follows.

The thus processed sample was measured for density using a green filter. The results of measurement of photographic properties are shown in Table 6.

The color development processing was conducted as follows at 38° C. throughout the processing.

1. Color Development (2 min 45 sec)
2. Bleaching (6 min 30 sec)
3. Washing (3 min 15 sec)
4. Fixing (6 min 30 sec)
5. Washing (3 min 15 sec)
6. Stabilization (3 min 15 sec)

Each of the processing solutions herein used had the following composition.

| | |
|---|---|
| Color Developing Solution: | |
| Sodium Nitrilotriacetate | 1.0 g |
| Sodium Sulfite | 4.0 g |
| Sodium Carbonate | 30.0 g |
| Potassium Bromide | 1.4 g |
| Hydroxylamine Sulfate | 2.4 g |
| 4-(N—Ethyl-N—β-hydroxyethylamino)-2-methylaniline Sulfate | 4.5 g |
| Water to make | 1 liter |
| Bleaching Solution: | |
| Ammonium Bromide | 160.0 g |
| Aqueous Ammonia (28 wt %) | 25.0 ml |
| Sodium (Ethylenediaminetetraacetato)-Iron | 130 g |
| Glacial Acetic Acid | 14 ml |
| Water to make | 1 liter |
| Fixing Solution: | |
| Sodium Tetrapolyphosphate | 2.0 g |
| Sodium Sulfite | 4.0 g |
| Ammonium Thiosulfate (70 wt %) | 175.0 ml |
| Sodium Bisulfite | 4.6 g |
| Water to make | 1 liter |
| Stabilizer: | |
| Formalin | 8.0 ml |
| Water to make | 1 liter |

TABLE 6

| Sample No. | Fog | Relative Sensitivity |
|---|---|---|
| H (Comparison) | 0.15 | 100 (standard) |
| I (Invention) | 0.15 | 180 |
| J (Invention) | 0.14 | 110 |

TABLE 6-continued

| Sample No. | Fog | Relative Sensitivity |
|---|---|---|
| (Invention) | | |

The results of Table 6 revealed that use of hydrogen peroxide for deactivation of the silver halide solvent brings about a considerable improvement of relative sensitivity without increasing fog (Sample I).

Further, Sample J in which smaller grains were used could achieve relative sensitivity not lower than that of Sample H without increasing fog.

EXAMPLE 4

(1) Preparation of Comparative Tabular Grains

The same procedure as in Example 2-(1) was repeated except for using a further increased amount of the thioether compound and a decreased amount of the potassium iodide solution. The resulting tabular grains were found to have a mean diameter of 0.85 μm, a thickness of 0.23 μm, a mean diameter/thickness ratio of 3.7 and a silver iodide content of 1.5 mol%.

The resulting emulsion was subjected to the same treatment as in Example 1-(1), including washing with water, chemical sensitization, addition of green-sensitizing dye and coating. The resulting sample was designated as Sample K.

(2) Preparation of Tabular Grains According to Invention

Sample L was prepared in the same manner as described in (1) above except for adding 50 g of $K_2S_2O_8$ after completion of the addition of silver nitrate and potassium iodide solutions and before the chemical sensitization.

(3) Evaluation of Photographic Properties

Each of Samples K and L was exposed and developed in the same manner as described in Example 1. The results obtained are shown in Table 7.

TABLE 7

| Sample No. | Fog | Relative Sensitivity |
|---|---|---|
| K (Comparison) | 0.02 | 100 (standard) |
| L (Invention) | 0.01 | 155 |

As shown in Table 7, relative sensitivity can markedly be improved without increasing fog by deactivating the silver halide solvent with $K_2S_2O_8$ (Sample L).

While the invention has been described in detail and with reference to specific embodiments thereof, it will be apparent to one skilled in the art that various changes and modifications can be made therein without departing from the spirit and scope thereof.

What is claimed is:

1. A process for producing a tabular silver halide emulsion using a sulfur-containing silver halide solvent that promotes growth of silver halide grains, which comprises using an oxidizing agent capable of reducing or eliminating the grain growth effect of said sulfur-containing silver halide solvent.

2. A process as claimed in claim 1, wherein said sulfur-containing silver halide solvent is a thiocyanate, an organic thioether compound, a thione compound or a mercapto compound.

3. A process as claimed in claim 2, wherein said thiocyanate is potassium thiocyanate or ammonium thiocyanate.

4. A process as claimed in claim 2, wherein said organic thioether compound is a compound represented by the formula (I):

$$R^1(S-R^3)_m-S-R^2 \quad (I)$$

wherein $R^1$ and $R^2$, which may be the same or different, each represents a lower alkyl group having from 1 to 5 carbon atoms or a substituted alkyl group having from 1 to B 30 carbon atoms in total; or $R^1$ and $R^2$ may be taken together to form a cyclic thioether; $R^3$ represents a substituted or unsubstituted alkylene group having from 1 to 12 carbon atoms; and m represents 0 or an integer of from 1 to 4; when m is 2 or more, a plurality of $R^3$ may be the same or different.

5. A process as claimed in claim 2, wherein said thione compound is a compound represented by the formula (II):

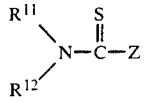

(II)

wherein Z represents

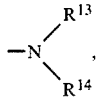

$-OR^{15}$ or $-SR^{16}$; $R^{11}$, $R^{12}$, $R^{13}$, $R^{14}$, $R^{15}$ and $R^{16}$, which may be the same or different, each represents a substituted or unsubstituted alkyl group, a substituted or unsubstituted alkenyl group, a substituted or unsubstituted aralkyl group, a substituted or unsubstituted aryl group, or a substituted or unsubstituted heterocyclic group, each preferably having a total carbon atom number of not more than 30; or a pair of $R^{11}$ and $R^{12}$, $R^{13}$ and $R^{14}$, $R^{11}$ and $R^{13}$, $R^{11}$ nad $R^{15}$, or $R^{11}$ and $R^{16}$ may be taken together to form a substituted or unsubstituted 5- or 6-membered heterocyclic ring.

6. A process as claimed in claim 2, wherein said mercapto compound is a compound represented by the formula (III):

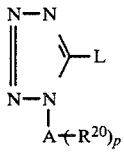

(III)

wherein A represents an alkylene group; $R^{20}$ represents $-NH_2$, $-NHR^{21}$,

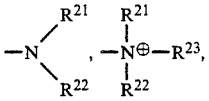

$-CONHR^{24}$, $-OR^{24}$, $-COOM$, $-COOR^{21}$, $-SO_2NHR^{24}$, $-NHCOR^{21}$ or $-SO_3M$, each preferably having a total carbon atom number of not more than 30; p represents 1 or 2; and L represents $-S^{\ominus}$ when $R^{20}$ is

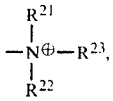

or L represents $-SM$ when $R^{20}$ is a group other than

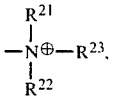

wherein $R^{21}$, $R^{22}$ and $R^{23}$ each represents an alkyl group; $R^{24}$ represents a hydrogen atom or an alkyl group; and M represents a hydrogen atom or a cation.

7. A process as claimed in claim 1, wherein said oxidizing agent is an organic oxidizing agent or an inorganic oxidizing agent.

8. A process as claimed in claim 7, wherein said organic oxidizing agent is peracetic acid or perbenzoic acid.

9. A process as claimed in claim 7, wherein said inorganic oxidizing agent in hydrogen peroxide, an adduct of hydrogen peroxide, a peroxy acid salt, a peroxy complex compound, a permanganate or a chromate.

10. A process as claimed in claim 7, wherein said oxidizing agent is hydrogen peroxide, or an adduct of hydrogen peroxide.

11. A process as claimed in claim 1, wherein said oxidizing agent is an oxidizing gas.

12. A process as claimed in claim 1, wherein said oxidizing agent is a halogen-releasing oxidizing compound.

13. A process as claimed in claim 1, wherein said sulfur-containing silver halide solvent is used in an amount of from $10^{-6}$ to 20 mols per mol of silver halide.

14. A process as claimed in claim 1, wherein said sulfur-containing silver halide solvent is used in an amount of from $10^{-5}$ to 10 mols per mol of silver halide.

15. A process as claimed in claim 1, wherein said oxidizing agent is used in an amount of from 1/100 to 100 molar times based on said sulfur-containing silver halide solvent.

16. a process as claimed in claim 1, wherein said oxidizing agent is used after addition of the sulfur-containing silver halide solvent.

17. A process as claimed in claim 1, wherein said oxidizing agent is used before commencement of chemical ripening.

18. A process as claimed in claim 1, wherein said process further comprises using a reducing material.

19. A process as claimed in claim 18, wherein said reducing material is a sulfite, a sulfinic acid or a reducing sugar.

20. A process as claimed in claim 18, wherein said reducing material is used in an amount of from B 1 to 5 mols per mol of said oxidizing agent.

21. A process as claimed in claim 18, wherein said reducing material is used after the addition of the oxidizing agent and before the commencement of chemical ripening.

22. A process as claimed in claim 1, wherein said tabular silver halide emulsion contains tabular silver halide grains having a diameter 5 to 50 times a thickness.

23. A process as claimed in claim 22, wherein said tabular silver halide grains have a diameter of 0.3 to 5.0 μm.

24. A process as claimed in claim 22, wherein said tabular silver halide emulsion contains at least 40% by weight of said tabular silver halide grains based on the total silver halide grains.

* * * * *